US006165601A

United States Patent [19]

Noda et al.

[11] Patent Number: 6,165,601

[45] Date of Patent: Dec. 26, 2000

[54] ELECTROMAGNETIC-WAVE ABSORBER

[75] Inventors: Kenichi Noda, Nagoya; Takashi Sakurai, Seto, both of Japan

[73] Assignee: Ten Kabushiki Kaisha, Nagoya, Japan

[21] Appl. No.: 09/262,661

[22] Filed: Mar. 4, 1999

Related U.S. Application Data

[63] Continuation-in-part of application No. 08/739,181, Oct. 30, 1996, abandoned.

[30] Foreign Application Priority Data

Oct. 5, 1996 [JP] Japan ..... 8-283395

[51] Int. Cl.[7] ..... H01Q 17/00

[52] U.S. Cl. ..... 428/215; 428/332; 428/469; 428/702; 342/1

[58] Field of Search ..... 428/215, 469, 428/332, 702; 342/1–4, 22

[56] References Cited

U.S. PATENT DOCUMENTS

| | | | |
|---|---|---|---|
| 3,754,255 | 8/1973 | Suetake et al. . | |
| 4,012,738 | 3/1977 | Wright . | |
| 4,023,174 | 5/1977 | Wright | 343/18 |
| 5,081,455 | 1/1992 | Inui et al. . | |
| 5,296,859 | 3/1994 | Naito et al. . | |
| 5,323,160 | 6/1994 | Kim et al. | 342/1 |
| 5,453,745 | 9/1995 | Kudo et al. . | |
| 5,455,117 | 10/1995 | Nagano et al. . | |
| 5,617,096 | 4/1997 | Takahashi . | |
| 5,872,534 | 2/1999 | Mayer | 342/1 |
| 6,037,046 | 3/2000 | Joshi et al. | 428/212 |

OTHER PUBLICATIONS

Article entitled "Criteria for Absorber's Reflectivity Lined In Semi–Anechoic Chambers Using Ray–Tracing Technique" by Naito, et al., IEEE 1996 International Symposium on Electromagnetic Compatibility, at Santa Clara, CA., Aug. 19–23, 1996, title and index page and pp. 140–142.

*Primary Examiner*—Stevan A. Resan
*Attorney, Agent, or Firm*—Frishauf, Holtz, Goodman, Langer & Chick, P.C.

[57] ABSTRACT

An electromagnetic wave absorber includes a metal plate capable of reflecting electromagnetic waves and adapted to be fitted onto a fixed object. A first sintered ferrite plate is disposed in front of the metal plate, and has a thickness of between 3 and 5 mm. A dielectric member is disposed in front of the first sintered plate, and has a low dielectric constant and a thickness between 10 and 30 mm. And a second sintered ferrite plate is disposed in front of the dielectric member, and has a thickness of between 1 and 2 mm.

5 Claims, 5 Drawing Sheets

ELECTROMAGNETIC-WAVE ABSORBER

CROSS REFERENCE TO RELATED APPLICATION

This is a continuation-in-part of prior application Ser. No. 08/739,181, filed Oct. 30, 1996 now abandoned, the entire contents of which are incorporated herein by reference.

FIELD OF INVENTION

The present invention relates to an electromagnetic-wave absorber to be attached to the wall surface or the like of anechoic chamber and the outside wall surface or the like of buildings (tall buildings) to absorb electromagnetic waves. More particularly, it relates to an electromagnetic-wave absorber which can absorb electromagnetic waves over frequency band between at least approximately 0.05 GHz and 2 GHz with a high damping factor of at least −20 dB (approximately 99% or more in view of electromagnetic absorption ratio), while reducing the thickness and the weight thereof.

DESCRIPTION OF THE PRIOR ARTS

In the prior arts of the electromagnetic-wave absorber, there was used a ferrite plate of the required thickness set to $\lambda/4$ of the frequency of the electromagnetic waves to be absorbed attached with a metal plate for reflecting electromagnetic waves on the back thereof. However, since the electromagnetic waves were absorbed in different frequency bands due to the composition, thickness and the like of the ferrite sheet, it was required to from the electromagnetic-wave absorber by lapping a plurality of ferrite plates each having a composition, predetermined thickness and the like corresponding to the frequency of the electromagnetic waves to absorb the electromagnetic waves in a frequency band between approximately 0.05 GHz and 2 GHz with a high damping factor of at least −20 dB.

Consequently, in the conventional electromagnetic-wave absorber which can absorb electromagnetic waves over a broad band, it was inevitable that the thickness and the weight were increased. Moreover, the conventional electromagnetic-wave absorber required much labor and a large space for being attached to anechoic chamber and buildings so that it was difficult to save on space.

SUMMARY OF THE INVENTION

The present invention is directed to solve above-described problems in the prior arts, and the object is to provide an electromagnetic-wave absorber which is able to absorb the electromagnetic waves in frequency band between approximately 0.05 GHz and 2 GHz with a high damping factor of at least −20 dB, while reducing the thickness and the weight thereof.

Another object of the present invention is to provide an electromagnetic-wave absorber superior in workability for attaching itself and which has a shortened of construction.

To accomplish those objects, an electromagnetic-wave absorber for achieving a damping ratio of at least −20 dB in frequency band between at least approximately 0.05 GHz and 2 GHz, said electromagnetic wave absorber comprising a metal plate capable of reflecting electromagnetic wave and adapted to be fitted onto a fixed object, a first sintered ferrite plate disposed in front of said metal plate, said first sintered ferrite plate having a thickness of 4.0 to 4.5 mm, a dielectric member disposed in front of said first sintered plate, said dielectric member having a low dielectric constant and a thickness of 20 to 25 mm; and a second sintered ferrite plate disposed in front of said dielectric member, said second sintered ferrite plate having a thickness of 1.0 to 1.5 mm.

DETAILED DESCRIPTION OF THE INVENTION

Referring to the accompanying drawings of the embodiments, the present invention will be described hereinafter.

The Basic Embodiment

Figure 1:
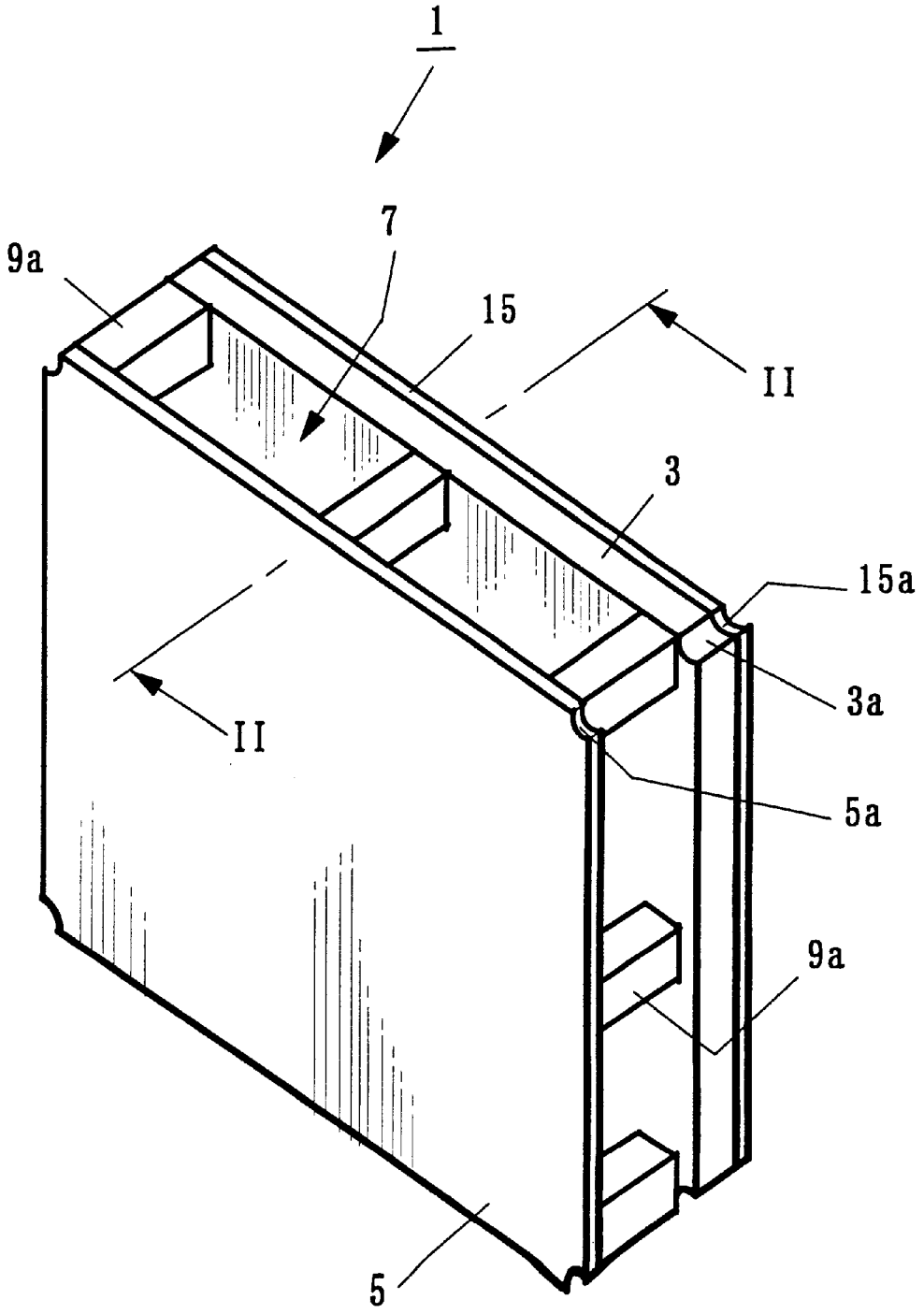
FIG. 1 is general perspective view of the electromagnetic-wave absorber according to the invention.
Figure 2:
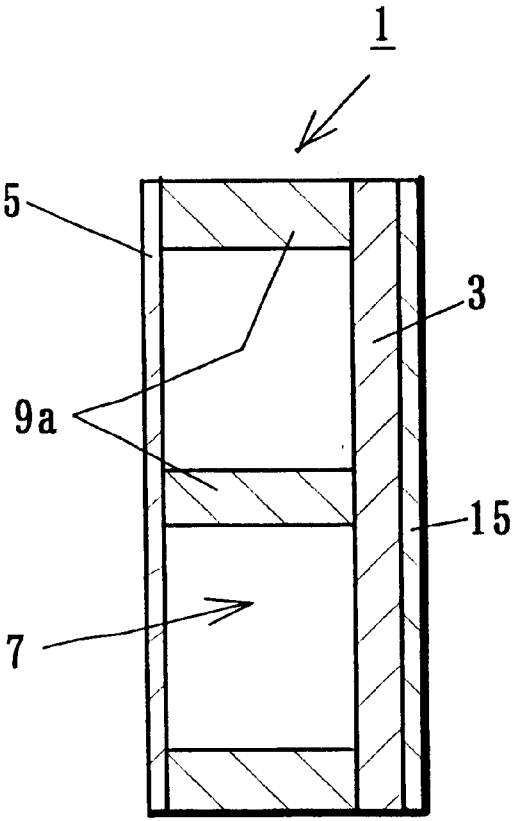
FIG. 2 is a vertical sectional view taken on line II—II in FIG. 1.

In FIG. 1 to 2, a first sintered ferrite plate 3 and second sintered ferrite plate 5 of an electromagnetic-wave absorber 1 are made of nickel-zinc or the like and formed in rectangular plates of substantially equal size. The first sintered ferrite plate 3 is of about 4 to 4.5 mm thickness and the second sintered ferrite plate 5 is of 1.5 to 2 mm thickness. A air layer 7 as a dielectric means is placed between the first and second sintered ferrite plates 3, 5 which are set at an interval about 20 to 22 mm wide. Those first and second sintered ferrite plates 3, 5 may be cut out from a sintered ferrite board into flat plates with the respective thickness as described above or may be individually formed by burning to have the above-described thickness. Furthermore, the first and second sintered ferrite plates each have a same characteristics and have a magnetic permeability of approximately 1000 to 2000 at 10 MHz.

Between the first sintered ferrite plate 3 and second sintered ferrite plate 5 are provided the air layer 7 through which the mutual interval is kept in about 20 to 25 mm between the first and second sintered ferrite plates 3, 5.

In case of the air layer 7, spacers 9*a* with the length equal to the above-described interval may be arranged at suitable locations between the first and second sintered ferrite plates 3, 5 to keep the gap of the air layer 7.

The above-described first sintered ferrite plate 3 is attached on the back thereof with a reflector metal plate 15 of which the size is equal to that of the first sintered ferrite plate 3. The reflector metal plate 15 may be any metal plate having the characteristic of reflecting the electromagnetic wave such as iron, copper, brass, nickel.

In consideration of the workability for attaching the electromagnetic-wave absorber to anechoic chamber and buildings, the first sintered ferrite plate 3, second sintered ferrite plate 5 and reflector metal plate 15 are provided at the respective corners with cutaway portions 3*a*, 5*a*, 15*a* of a quadrant shape, respectively. The respective cutaway portions 3*a*, 5*a*, 15*a* may be joined together to form holes for inserting the fixing screws to attach a large number of electromagnetic-wave absorbers to the wall surface when they are arranged adjacent to each other.

The above described electromagnetic-wave absorber 1 absorbs electromagnetic waves in the operation to be described hereinafter.

Figure 3:
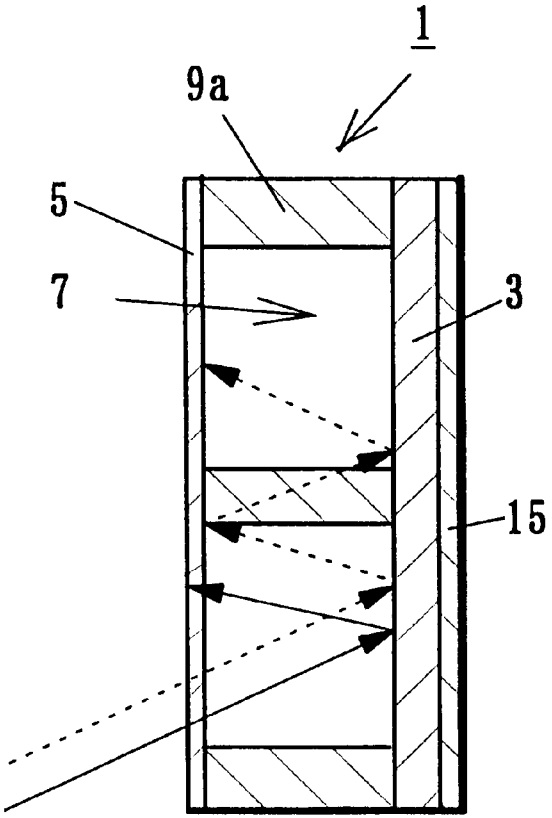
FIG. 3 is a functional diagram illustrating the absorbing condition of the electromagnetic-wave absorber.

In FIG. 3, when an electromagnetic wave with comparative low frequency (approximately 0.05 to 1 GHz) confronts the electromagnetic-wave absorber 1, a part of the electromagnetic wave as shown in the solid line in FIG. 3 is absorbed due to the permeability during its penetrating through the second sintered ferrite plate 5. The rest of the electromagnetic wave which has penetrated though the second sintered plate 5 is absorbed in the same way as described above during its penetrating though the first sintered ferrite plate 3 and thereafter reflected by the reflector metal plate 15 to be absorbed and damped during its penetrating again through the first and second sintered ferrite plates 3, 5.

On the other hand, when an electromagnetic wave with a comparatively high frequency (over approximately 1 GHz to 2 GHz) confronts the electromagnetic-wave absorber 1, the electromagnetic wave as shown in the dotted line in FIG. 3 penetrates through the second sintered plate 5 and first sintered ferrite plate 3. Thereafter the electromagnetic wave resonates with multiple reflection between the first and second sintered ferrite plates 3, 5 due to the reflector metal plate 15 to be damped due to the dielectric loss by the air layer 7 between both the sintered ferrite plates.

Consequently, electromagnetic wave absorber 1 can absorb the electromagnetic wave over a broad band of approximately 0.05 GHz to 2 GHz with a high damping factor of at least −20 dB owing to the fact that the air layer 7 is provided between the first and second sintered ferrite plates 3, 5 with small thickness.

Also, since a very thin plate can be used for the first and second sintered ferrite plates 3, 5 of the electromagnetic-wave absorber 1, it is possible to reduce the thickness and the weight of the electromagnetic-wave absorber 1 itself. Moreover, it is possible to efficiently perform the work for attaching the electromagnetic-wave absorber 1 to anechoic chamber and building so as to shorten the period of construction.

Although it is desirable that the characteristic of absorbing electromagnetic waves in the electromagnetic-wave absorber 1 according to the present invention is −20 dB or more in damping factor.

Example in the Prior Art

Thickness 6.5 mm, Flat type sintered ferrite plate

In the frequency band between 0.05 GHz and 0.427 GHz, the damping factor was −20 dB or more, but in the band 0.427 GHz to 2 GHz the damping factor was −20 dB or less.

(1). Example Corresponding to Claim 1

Thickness of the first sintered ferrite plate: 4.5 mm

Thickness of the second sintered ferrite plate: 1.5 mm

Magnetic permeability: 1500 at 10 MHz

Thickness of the air layer: 22 mm

Figure 4:
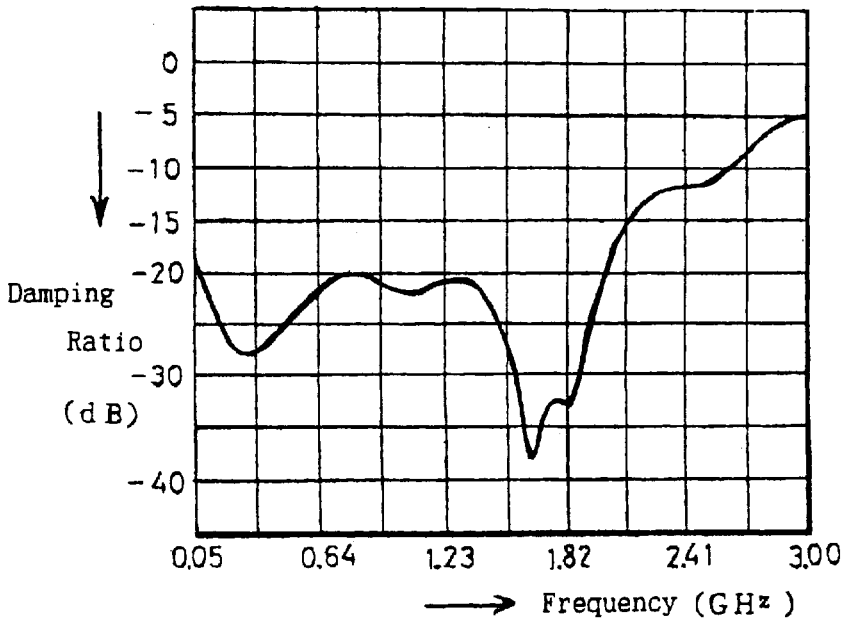
FIG. 4 is a graph illustrating the characteristic of absorbing the electromagnetic wave corresponding to the invention of claim 1.

As shown in FIG. 4, in the band about 0.08 GHz to 2.011 GHz, the damping factor was −20 dB or more.

(2). Example Corresponding to Claim 2

Thickness of the first sintered ferrite plate: 4.5 mm

Thickness of the second sintered ferrite plate: 1.7 mm

Magnetic permeability: 1500 at 10 MHz

Thickness of the air layer: 22 mm

Figure 5:
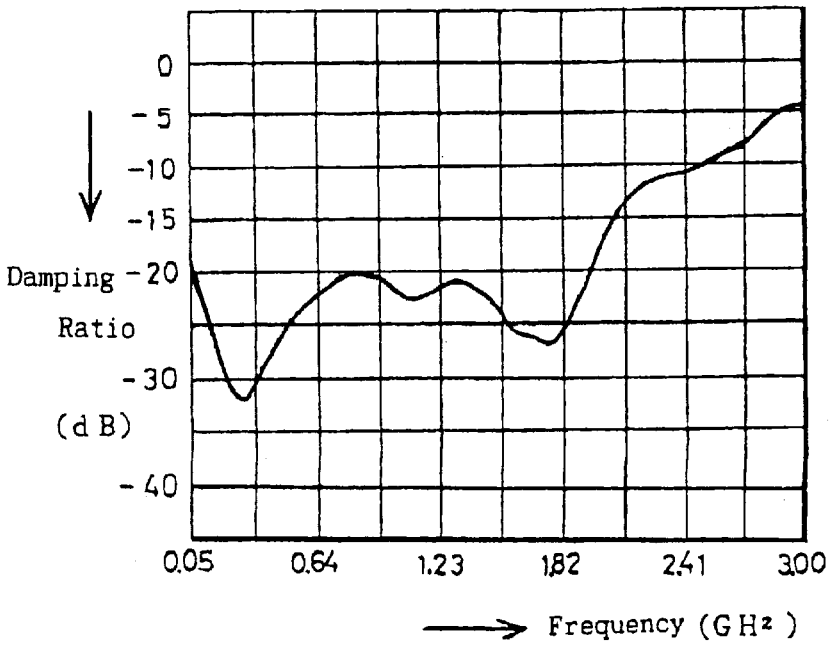
FIG. 5 is a graph illustrating another characteristic of absorbing the electromagnetic wave corresponding to the invention of claim 2.

As shown in FIG. 5, in the frequency bands between about 0.06 GHz and 1.9 GHz, the damping factor was −20 dB or more.

(3). Example Corresponding to Claim 3

Thickness of the first sintered ferrite plate: 4.0 mm

Thickness of the second sintered ferrite plate: 2.0 mm

Magnetic permeability: 1500 at 10 MHz

Thickness of the air layer: 20 mm

Figure 6:
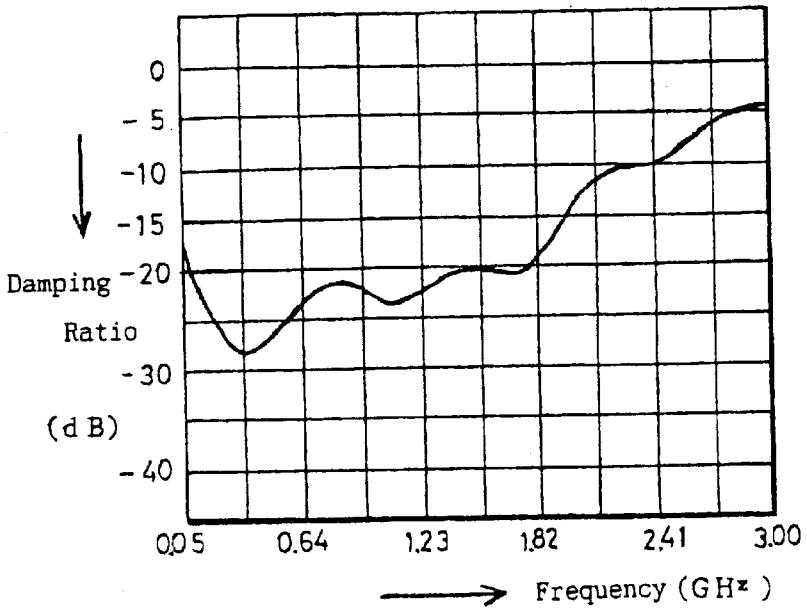
FIG. 6 is a graph illustrating the characteristic of absorbing the electromagnetic wave corresponding to the invention of claim 3.

As shown in FIG. 6, in the frequency between about 0.08 GHz and 1.78 GHz, the damping factor was −20 dB or more.

(4). Example Corresponding to Claim 4

Thickness of the first sintered ferrite plate: 4.0 mm

Thickness of the second sintered ferrite plate: 1.7 mm

Magnetic permeability: 1500 at 10 MHz

Thickness of the air layer: 20 mm

Figure 7:
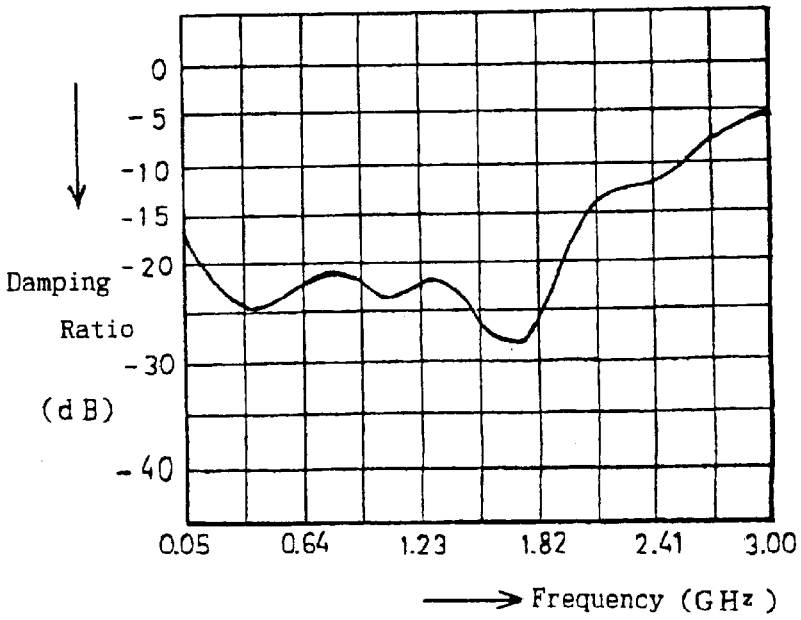
FIG. 7 is a graph illustrating another characteristic of absorbing the electromagnetic wave corresponding to the invention of claim 4.

As shown in FIG. 7, in the frequency bands between approximately 0.095 GHz and 1.94 GHz, the damping factor was −20 dB or more.

(5). Example Corresponding to Claim 5

Thickness of the first sintered ferrite plate: 4.0 mm

Thickness of the second sintered ferrite plate: 1.5 mm

Magnetic permeability: 1500 at 10 MHz

Thickness of the air layer: 20 mm

Figure 8:
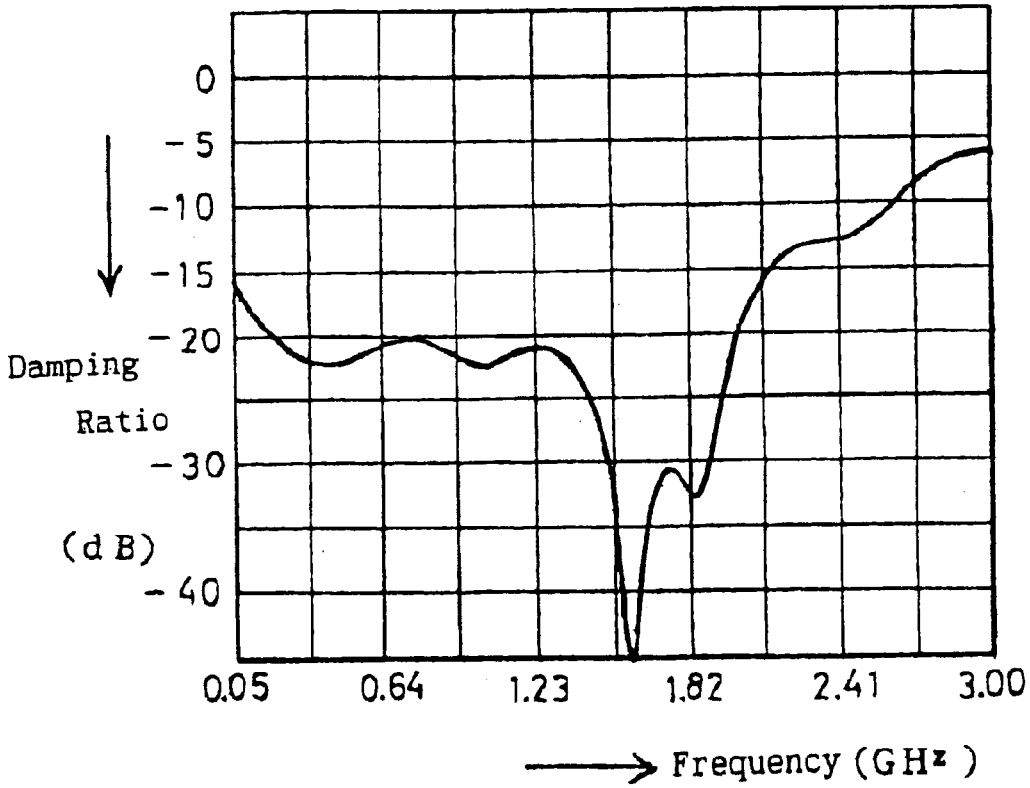
FIG. 8 is a graph illustrating the characteristic of absorbing the electromagnetic wave corresponding to the invention of claim 5.

As shown in FIG. 8, in the frequency bands between about 0.19 GHz and 2.01 GHz, the damping factor was −20 dB or more.

What is claimed is:

1. An electromagnetic wave absorber for achieving a damping ratio of at least −20 dB in frequency band between approximately 0.08 GHz and 2.01 GHz, said electromagnetic wave absorber comprising:

a metal plate capable of reflecting electromagnetic wave and adapted to be fitted onto a fixed object;

a first sintered ferrite plate disposed in front of said metal plate, said first sintered ferrite plate having a thickness of 4.5 mm;

a dielectric member disposed in front of said first sintered plate, said dielectric member comprises an air layer and having a low dielectric constant and a thickness of 22 mm; and a second sintered ferrite plate disposed in front of said dielectric member, said second sintered ferrite plate having a thickness of 1.5 mm; and the first and second sintered ferrite plates each have a magnetic permeablity of approximately 1000 to 2000 at 10 MHz.

2. An electromagnetic wave absorber for achieving a damping ratio of at least −20 dB in frequency band between approximately 0.06 GHz and 1.9 GHz, said electromagnetic wave absorber comprising:

a metal plate capable of reflecting electromagnetic wave and adapted to be fitted onto a fixed object;

a first sintered ferrite plate disposed in front of said metal plate, said first sintered ferrite plate having a thickness of 4.5 mm;

a dielectric member disposed in front of said first sintered plate, said dielectric member comprises an air layer and having a low dielectric constant and a thickness of 22 mm; and a second sintered ferrite plate disposed in front of said dielectric member, said second sintered ferrite plate having a thickness of 1.7 mm;

the first and second sintered ferrite plates each have a magnetic permeablity of approximately 1000 to 2000 at 10 MHz.

3. An electromagnetic wave absorber for achieving a damping ratio of at least −20 dB in frequency band between approximately 0.08 GHz and 1.78 GHz, said electromagnetic wave absorber comprising:

a metal plate capable of reflecting electromagnetic wave and adapted to be fitted onto a fixed object;

a first sintered ferrite plate disposed in front of said metal plate, said first sintered ferrite plate having a thickness of 4.0 mm;

a dielectric member disposed in front of said first sintered plate, said dielectric member comprises an air layer and having a low dielectric constant and a thickness of 20 mm; and a second sintered ferrite plate disposed in front of said dielectric member, said second sintered ferrite plate having a thickness of 2.0 mm;

the first and second sintered ferrite plates each have a magnetic permeablity of approximately 1000 to 2000 at 10 MHz.

4. An electromagnetic wave absorber for achieving a damping ratio of at least −20 dB in frequency band between approximately 0.095 GHz and 1.94 GHz, said electromagnetic wave absorber comprising:

a metal plate capable of reflecting electromagnetic wave and adapted to be fitted onto a fixed object;

a first sintered ferrite plate disposed in front of said metal plate, said first sintered ferrite plate having a thickness of 4.0 mm;

a dielectric member disposed in front of said first sintered plate, said dielectric member comprises an air layer and having a low dielectric constant and a thickness of 20 mm; and a second sintered ferrite plate disposed in front of said dielectric member, said second sintered ferrite plate having a thickness of 1.7 mm;

the first and second sintered ferrite plates each have a magnetic permeablity of approximately 1000 to 2000 at 10 MHz.

5. An electromagnetic wave absorber for achieving a damping ratio of at least −20 dB in frequency band between approximately 0.19 GHz and 2.01 GHz, said electromagnetic wave absorber comprising:

a metal plate capable of reflecting electromagnetic wave and adapted to be fitted onto a fixed object;

a first sintered ferrite plate disposed in front of said metal plate, said first sintered ferrite plate having a thickness of 4.0 mm;

a dielectric member disposed in front of said first sintered plate, said dielectric member comprises an air layer and having a low dielectric constant and a thickness of 20 mm; and a second sintered ferrite plate disposed in front of said dielectric member, said second sintered ferrite plate having a thickness of 1.5 mm;

the first and second sintered ferrite plates each have a magnetic permeablity of approximately 1000 to 2000 at 10 MHz.

* * * * *